US005759731A

United States Patent [19]

Hagi et al.

[11] Patent Number: 5,759,731

[45] Date of Patent: Jun. 2, 1998

[54] TONER FOR ELECTROPHOTOGRAPHY WITH SPECIFIED FINE PARTICLES ADDED EXTERNALLY

[75] Inventors: Masayuki Hagi, Takatsuki; Takeshi Arai, Akashi; Junichi Tamaoki, Sakai; Hiroyuki Fukuda, Kobe, all of Japan

[73] Assignee: Minolta, Co., Ltd., Osaka, Japan

[21] Appl. No.: 879,328

[22] Filed: Jun. 20, 1997

[30] Foreign Application Priority Data

Jun. 21, 1996 [JP] Japan ..... 8-161627
Jun. 21, 1996 [JP] Japan ..... 8-161628

[51] Int. Cl.[6] ..... G03G 9/097; G03G 9/107

[52] U.S. Cl. ..... 430/106.6; 430/110; 430/111

[58] Field of Search ..... 430/106.6, 110, 430/111

[56] References Cited

U.S. PATENT DOCUMENTS 4,623,605 11/1986 Kato et al. ..... 430/110
4,652,509 3/1987 Shirose et al. ..... 430/110
4,904,558 2/1990 Nagatsuka et al. ..... 430/122
5,155,000 10/1992 Matsumura et al. ..... 430/110
5,272,040 12/1993 Nakasawa et al. ..... 430/110
5,508,139 4/1996 Tanaka et al. ..... 430/111
5,627,000 5/1997 Yamazaki et al. ..... 430/99
5,707,772 1/1998 Akimoto et al. ..... 430/110

*Primary Examiner*—Ronald Martin

[57] ABSTRACT

The invention relates to (1) a toner with inorganic fine particles added externally, the inorganic fine particles having a specified mean particle size and a specified particle size distribution, and (2) a toner having specified particle size, specific gravity, and angle of toner repose, and a developing agent comprising the toner and a carrier.

The toner of the present invention has good environmental stability, non-sticking characteristic, and good storage stability under hot conditions, and is capable of forming good images without aggregation noise. Further, the toner is not liable to produce toner dust and does not damage the photoconductor. The toner is particularly suitable for full-color image formation.

20 Claims, 1 Drawing Sheet

TONER FOR ELECTROPHOTOGRAPHY WITH SPECIFIED FINE PARTICLES ADDED EXTERNALLY

BACKGROUND OF THE INVENTION

1. Field of the Invention

The present invention relates to an electrostatic latent image developing toner for developing an electrostatic latent image formed on an electrostatic latent image supporting member.

2. Description of the Prior Art

In the art of image reproduction, such as copying machine, printer, and facsimile, there has been widely employed an image forming method such that an electrostatic latent image formed on an electrostatic latent image supporting member, such as a photoconductor, is developed with a toner, the developed toner image being transferred onto a recording member such as recording paper. Such a method has also been employed in various types of full-color image forming apparatuses for reproducing a multi-color image by placing plural color toners one over another.

Varying characteristic features are required of electrostatic latent image developing toners for use in such different types of image forming apparatuses. For example, in a variable contrast image reproduction system, such as a variable area gradation system or a laser intensity modulation system, as employed in digital image forming apparatuses, high fluidity is required of the toner in order that image reproduction with satisfactory gradation may be achieved. More particularly, in the laser intensity modulation system, in which tone reproduction is carried out according to a change in toner deposit corresponding to a change in the charge quantity of latent image due to a laser intensity modulation, higher fluidity is required of the toner.

In order to enhance fluidity, it is effective to externally add, as a fluidizing agent, inorganic fine particles, such as silica fine particles, to the toner, thereby to increase the quantity of addition of such fine particles. However, with a toner which has been highly fluidized through the addition of silica fine particles or the like in a larger quantity, the trouble is that at the time of repetition of copy the toner tends to fly within the developing apparatus or in the developing region because of its high fluidity, thus causing the problem of toner dusting. In order to prevent toner dusting, an effective approach is to increase the quantity of toner charge. However, this involves the danger of lowering the developing capability of the toner which, in turn, causes the problem of image density degradation, and this tendency is more pronounced under ambient conditions of low temperature and low humidity in particular. In order to improve the developing function of the toner, it is necessary to further enhance the fluidity of the toner. Whichever of these approaches may be adopted, therefore, the result is simply such that an improvement in one aspect is counterbalanced by a deficiency in another aspect. As such, there has been no fundamental solution to the above noted problem.

A full-color toner is required to have light-transmission properties. Therefore, the binder resin used in full-color toner particles must have sharp melt properties. However, toner particles having such properties are liable to aggregation due to a stress inside the development apparatus during the process of repetition of copy so that white spots due to such aggregation may easily occur in solid copied images.

Further, such toner is required to have various other characteristics including a narrower range of toner charge variations relative to changes in ambient conditions, such as ambient temperature and humidity, no possibility of toner component adhesion to the photoconductor (that is a cause of black spots, hereinafter sometimes referred to as BS), and no toner dusting or fogging due to developer deterioration even after repetition of copy.

In order to satisfy the foregoing characteristic requirements, however, various technical problems must be solved. To improve the toner fluidity, for example, an effective method is to externally add a fluidizing agent, such as fine silica particles or fine titania particles, to the toner thereby to increase the quantity of addition of such agent. The increase in the quantity of an externally added component will result in an increase in the quantity of the component which passes through the cleaning blade and adheres to the surface of the photoconductor and, as a consequence, such externally added component will act as a nucleus to which other toner component may adhere in a trailing fashion during a cleaning operation. Thus, the problem of toner component adhesion to the photoconductor (i.e., problem of BS) will become more pronounced. If the quantity of such externally added component is decreased, not only will fluidity insufficiency be caused, but also toner aggregation will occur due to internal stress and the like within the developing apparatus during repetition of copy, with the result that there will arise the problem of voids in solid copied images. With a high-fluidity toner having a relatively large amount of silica fine particles or the like added thereto, the trouble is that silica fine particles or the like are liable to adhere to the carrier (spent) in the course of repetition of copy, resulting in reduced chargeability of the carrier relative to the toner and, in turn, reduced ability of the carrier to retain the toner electrostatically so that the problem of toner dusting will arise more noticeably.

SUMMARY OF THE INVENTION

It is an object of the present invention to provide an electrostatic latent image developing toner and developing agent which overcome the foregoing problems.

More specifically, it is an object of the invention to provide an electrostatic latent image developing toner and developing agent which have good fluidity and solve the problem of toner component adhesion to the photoconductor.

It is another object of the invention to provide an electrostatic latent image developing toner and developing agent which solve the problem of toner dusting and fogging.

It is another object of the invention to provide an electrostatic latent image developing toner and developing agent which involve no trouble of toner dusting or fogging even when copy is repeated and which enhance developer life.

It is another object of the invention to provide an electrostatic latent image developing toner and developing agent which have good environmental stability and involve only a small range of variations in toner charge due to humidity and/or temperature changes, and which involve no trouble of voids or the like in copied images.

It is another object of the invention to provide an electrostatic latent image developing toner and developing agent which can maintain a stable toner charge in a high temperature and high humidity environment and in a low temperature and low humidity environment.

It is a further object of the invention to provide an electrostatic latent image developing toner and developing agent which are suitable for use in full-color image formation.

The present invention provides a toner comprising:

toner particles, and strontium titanate fine particles having a number-mean particle size of from 80 to 800 nm, and a quantity of fine particles of 1000 nm or more is not more than 20 number %.

The present invention also provides a toner comprising:

colored particles;

toner particles having an angle of repose x (°), a volume-mean particle size D50 (μm), and an apparent specific gravity of looseness AD (g/cc) which respectively satisfy the following relations:

$$AD=(-0.005x+k1)\times(D50/8.5)^{1/2}$$

$$0.57\leqq k1\leqq 0.64$$

$$AD=k2x\ (D50)^{1/2}$$

$$0.135\leqq k2\leqq 0.158$$

$$28°\leqq x\leqq 38°$$

$$3\ \mu m\leqq D50\leqq 10\ \mu m$$

DETAILED DESCRIPTION OF THE INVENTION

Figure 1:
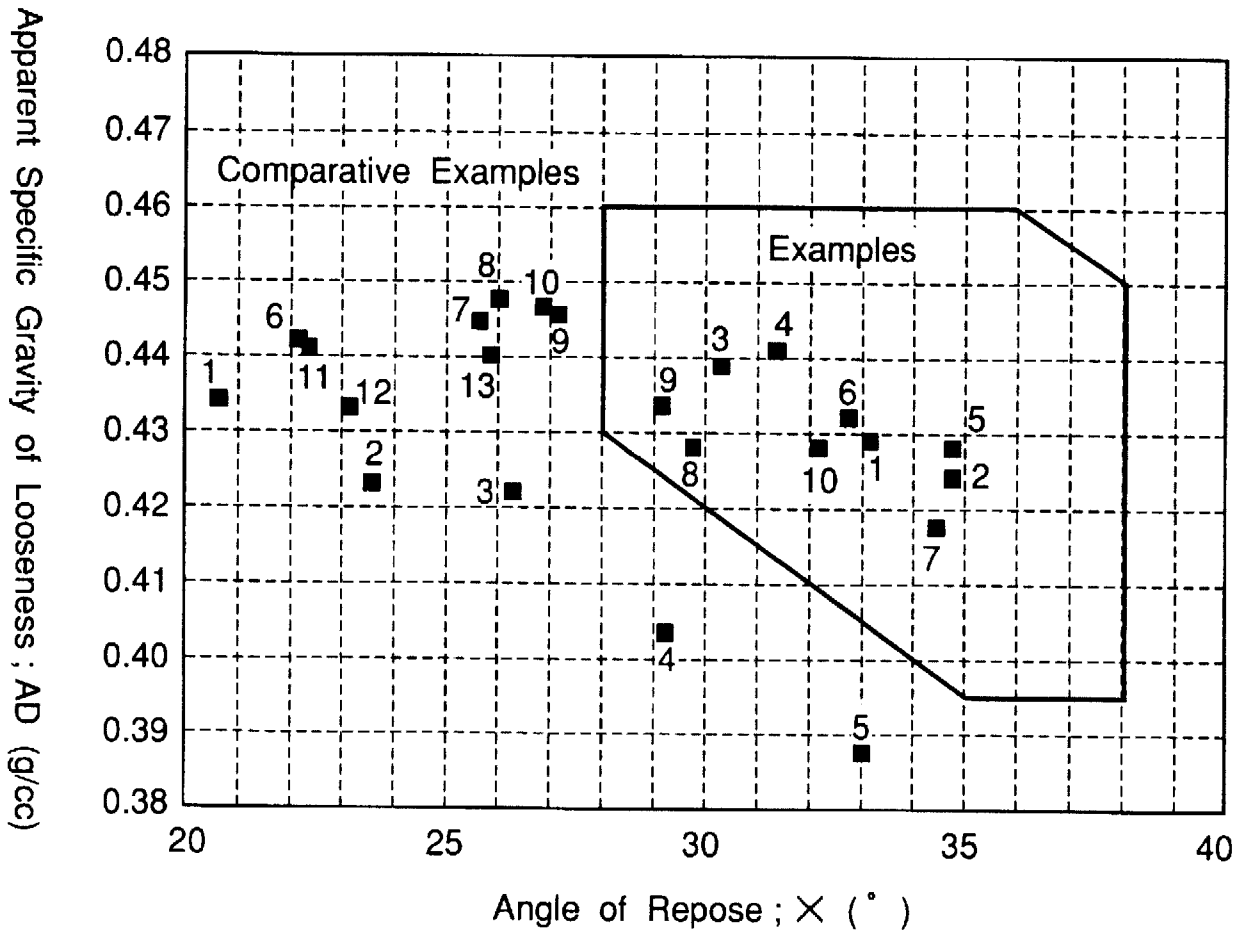
FIG. 1 is a diagram showing the relationship between apparent specific gravity of looseness and angle of repose in examples and comparative examples.

The foregoing objects of the present invention can be accomplished by:

(1) a toner added externally with inorganic fine particles having a specified mean particle size and a specified particle size distribution (hereinafter referred to as the "first invention"); or (2) a toner having a specified mean particle size, a specified specific gravity, and a specified toner angle of repose (hereinafter referred to as the "second invention").

First, description is given of the first invention.

The first invention pertains to an electrostatic latent image developing toner including toner particles containing at least a colorant and a binder resin, and an external additive added in mixture therewith, wherein the external additive comprise strontium titanate fine particles having a number-mean particle size of from 80 to 800 nm, the strontium fine particles including not more than 20 number % of particles having a particle size of 1000 nm or more. The toner may also include metallic oxide fine particles having a number-mean particle size of from 10 to 90 nm and surface-treated with a hydrophobicizing agent.

In the toner of the invention, toner particles are externally added with strontium titanate fine particles having a number-mean particle size of from 80 to 800 nm, preferably from 100 to 700 nm, more preferably from 150 to 600 nm, and including not more than 20 number %, preferably not more than 10 number %, of particles of 1000 nm or more. More preferably, the quantity of particles of 800 nm or more is not more than 20 number %, preferably not more than 10 number %. By using such strontium titanate fine particles, it is possible to eliminate, for example, troubles such as black spots (BS) and toner dust which may arise from the addition of metallic oxide fine particles, without involving the danger of the photoconductor being damaged.

If the number-mean particle size of strontium titanate fine particles is less than 80 nm, the fine particles have no sufficient effect to prevent the trouble of BS. If the number-mean particle size is more than 800 nm, such particles are liable to separate from toner particle surface, and this makes it difficult to retain the fine particles as attached to toner particle surface, so that the effect of the fine particles for preventing toner dust is lowered. If the proportion of particles of 1000 nm or more in particle size is more than 20 number %, there occurs a substantial increase in the quantity of strontium titanate fine particles which are present as free particles without being retained as attached to toner particle surface, with the result that above mentioned effect of the strontium titanate particles is lowered. Where the number-mean particle size is more than 800 nm or where the proportion of particles of 1000 nm or more is more than 20 number %, light permeability of the toner is adversely affected when the toner is used as a light permeable color toner; further, the photoconductor is liable to be damaged during a blade cleaning operation in case that repetitive image formation is carried out, or during a press transfer operation by means of a transfer drum in a full-color image forming apparatus.

The strontium titanate fine particles in the present invention include sintered aggregate particles of primary particles. Constituent primary particles of such aggregate have a mean primary particle size of from 30 to 150 nm, preferably from 50 to 100 nm. A sintered aggregate of such primary particles has a grape cluster-like shape.

Strontium titanate fine particles used in the present invention are smaller in particle size and include a smaller proportion of large-size particles as compared with such strontium titanate fine particles (with a number-mean particle size of from 1 to 3 μm) as are usually added externally to a toner as an abrasive material. The mechanism which permits the strontium titanate fine particles to exhibit such a good performance as mentioned above has not definitely been found, but conceivably it may be explained as follows.

Generally, strontium titanate fine particles of relatively large particle size, mixed with toner particles, are liable to separate from the toner particles, and this makes it difficult to uniformly attach such fine particles to the toner particles. In the toner, therefore, such fine particles are present as particles liberated from toner particles. In the present invention, however, the strontium titanate fine particles have a specified range of particle sizes as above described so that they have improved adherence relative to the toner particles. Since strontium titanate fine particles having a specified particle size are present as attached to toner particle surface in this way, the toner has undergone a characteristic change as a powder, being thus enabled to exhibit a dust preventive function. Further, it is conceived that because of the above described particle size range and configuration, the toner has improved function to prevent other minute particles from slipping through the blade during a blade cleaning operation, whereby BS can be effectively prevented.

In the present invention, strontium titanate fine particles are present as attached to the surface of toner particles, and it is specifically preferable that the number of particles of 200 nm or more attached to one toner particle is in a mean-number range of from 5 to 50, preferably from 10 to 30 when measured on the basis of an electromicroscopic photo observation. If the mean number of particles so attached is less than 5, the preventive effect of such particles against toner dusting is reduced, and if the mean number is more than 50, the charging characteristic of the toner may be adversely affected. The mean number range of such attached particles was calculated from an electromicroscopic photo taken of randomly sampled toner particles in such a way that the number of strontium titanate fine particles of 200 nm or more attached to each individual toner particle was counted and an average value of the counting was calculated as such.

Strontium titanate particles are added to the toner particles in a range of from 0.3 to 5.0% by weight, preferably from 0.5 to 3.0% by weight. If the quantity of addition is less than 0.3% by weight, no sufficient preventive effect against BS, toner dusting, and fogging can be obtained. If the quantity of addition is more than 5% by weight, the charging characteristic of the toner is adversely affected.

The strontium titanate fine particles may have been surface treated with a hydrophobicizing agent, an amino coupling agent, amino silicone oil, or the like, which are to be hereinafter described.

In the present invention, metallic oxide fine particles having a number-mean particle size of from 10 to 90 nm and surface-treated with a hydrophobicizing agent may be externally added, in combination with above mentioned strontium titanate fine particles, to the toner particles for mixture therewith. Such metallic oxide fine particles include, for example, fine particles of silica, titania, and alumina which may be used alone or in combination of two or more kinds. Metallic oxide fine particles will provide the toner with such characteristic effects as fluidity improvement, environment stability improvement, and void prevention.

It is desirable to use metallic oxide fine particles surface-treated with a hydrophobic agent and having, in particular, a hydrophobicity of 50 or more. By using such hydrophobicized metallic oxide fine particles it is possible to prevent a drop in the quantity of toner charge even under high-temperature and high-humidity conditions.

The quantity of addition of metallic oxide fine particles to toner particles is in the range of from 0.5 to 3.0% by weight, preferably from 1.0 to 2.5% by weight. If the quantity of addition is less than 0.5% by weight, the effect of such addition is insufficient, and if it is more than 3% by weight, the trouble of BS is likely to occur. More particularly, it is preferable to use metallic oxide fine particles in a quantity of 1.0% by weight or more from the standpoints of fluidity improvement and prevention of voids.

From the standpoints of fluidity improvement and prevention of toner charge drop at the time of high temperature and high humidity, it is preferable to use metallic oxide fine particles having a number mean particle size of from 10 to 30 nm, preferably from 10 to 25 nm, with a hydrophobicity of 50 or more. More specifically, it is preferable to use silica fine particles having such a characteristic feature.

From the standpoint of environmental stability improvement, and more specifically for preventing any image density drop due to a charge-up under low temperature/low humidity conditions, it is preferable to use titania fine particles having a number-mean particle size of from 10 to 90 nm, preferably from 30 to 80 nm. Further, it is desirable that the titania fine particles have a hydrophobicity of 50 or more from the view point of environmental stability. Useful types of titania fine particles include anatase-type titania, rutile-type, and amorphous titania, but anatase-type titania is preferred.

From the view points of void prevention and thermal storage stability improvement, it is desirable to use metallic oxide fine particles having a number-mean particle size of 30 to 90 nm, preferably from 40 to 80 nm. It is also desirable that such metallic oxide fine particles should have a hydrophobicity of 50 or more from the standpoint of environmental stability.

From these standpoints, the metallic oxide fine particles may be used in the form of a combination of two or more kinds of fine particles having such different functions as above mentioned. For this purpose, it is preferable to use silica fine particles of 10 to 30 nm in combination with titania fine particles of 10 to 90 nm, more particularly silica fine particles of 10 to 25 nm in combination with titania fine particles of 30 to 80 nm.

Hydrophobicizing agents useful for surface treatment of the metallic oxide fine particles include silane coupling agents, titanate coupling agents, silicone oils, and silicone varnishes. Examples of useful silane coupling agents are hexamethyl disilazane, trimethylsilane, chlorotrimethyl silane, dichlorodimethyl silane, trichloromethyl silane, allylchlorodimethyl silane, benzylchlorodimethyl silane, methyl trimethoxysilane, methyl triethoxysilane, isobutyl trimethoxysilane, dimethyl dimethoxysilane, dimethyl diethoxysilane, trimethyl methoxysilane, hydroxypropyl trimethoxysilane, phenyl trimethoxysilane, n-butyl trimethoxysilane, n-hexadecyl trimethoxysilane, n-octadecyl trimethoxysilane, vinyl trimethoxysilane, vinyl triethoxysilane, γ-methacryloxypropyl trimethoxysilane, and vinyl triacetoxysilane. Examples of useful silicone oils are dimethyl polysiloxane, methyl hydrogen polysiloxane, and methyl phenyl polysiloxane.

Surface treatment of the metallic oxide fine particles with any such hydrophobicizing agent may be carried out, for example, by a dry method in which the hydrophobicizing agent is diluted with a solvent and the dilute liquid is added to and mixed with the fine particles, the mixture being then heated and dried, then disintegrated, or by a wet method in which the fine particles are dispersed in an aqueous system to present a slurry form and the hydrophobicizing agent is added to and mixed with the slurry, the mixture being then heated and dried, then disintegrated. In particular, where the metallic oxide fine particles are of titania, the hydrophobicizing treatment of the titania fine particles is preferably carried out in an aqueous system from the view points of treated surface uniformity and aggregation preventive effect of titania particles.

For the purpose of the present invention, the degree of hydrophobicity was measured by a methanol wettability method. That is, droplets of methanol were dropped into a water in which a test sample was dispersed, and the weight of methanol required to wet the entire test sample was measured. In this measurement, the weight of methanol in the water plus methanol was expressed percentage, and the percentage obtained was taken as the degree of hydrophobicity.

External addition of above said strontium titanate fine particles or metallic oxide fine particles to the toner particles can be effected by mixing the former with the latter by means of a mixer such as Henschel mixer or the like. Where metallic oxide fine particles are used in combination with the strontium titanate fine particles, it is desirable that the toner particles and the metallic oxide fine particles are first mixed together and then the strontium titanate fine particles are introduced into the mixer for further mixing. Where two or more kinds of metallic oxide fine particles are used, it is desirable that metallic oxide fine particles having highest chargeability be first mixed with the toner particles, and thereafter other metallic oxide fine particles and strontium titanate fine particles be mixed with the toner particles, or mix other metallic oxide fine particles with the toner particles and then mix strontium titanate fine particles with the toner particles.

Then, the second invention will be explained.

The second invention pertains to an electrostatic latent image developing toner including toner particles containing a colorant and a binder resin, wherein the toner has an angle of repose X (°), a volume-mean particle size $D_{50}$ (μm), and an apparent specific gravity of looseness AD (g/cc) which satisfy the following relations (1)–(6):

$$AD=(-0.005x-k_1)\times(D_{50}/8.5)^{1/2} \quad (1)$$

$$k_1=0.57-0.64 \quad (2)$$

$$AD=k_2\times(D_{50})^{1/2} \quad (3)$$

$$K_2=0.135-0.158 \quad (4)$$

$$X=28°-38° \quad (5)$$

$$D_{50}=3-10\ \mu m \quad (6)$$

and also pertains to a developer comprising the toner and a carrier.

The present invention solves above noted problems by setting the angle of repose, volume-mean particle size, and apparent specific gravity of looseness with respect to the toner so that specified relations between them can be satisfied.

The present inventors made extensive research for solving the problems of dusting and fogging of toners by adding an external additive to the toner and found that it would be possible to impart high fluidity to the toner by controlling the apparent specific gravity of looseness within a specified range, and that the problems of toner dusting and fogging could be solved by controlling the angle of repose of the toner within a wider range than the conventional range even though the toner had such high fluidity. These findings led to the present invention.

The toner of the invention satisfies the conditions expressed by the following relations (1)–(6) with respect to angle of repose X (°), volume-mean particle size $D_{50}$ (μm), and apparent specific gravity of looseness AD (g/cc):

$$AD=(-0.005x+k_1)\times(D_{50}/8.5)^{1/2} \quad (1)$$

$$k_1=0.57-0.64 \quad (2)$$

$$AD=k_2\times(D_{50})^{1/2} \quad (3)$$

$$K_2=0.135-0.158 \quad (4)$$

$$X=28°-38° \quad (5)$$

$$D_{50}=3-10\ \mu m \quad (6)$$

By using toners having such characteristics it is possible to consistently achieve the purposes of enhancing fluidity and solving the problem of toner dusting.

In relation (1), if $k_1$ is smaller than 0.57, it is difficult to consistently achieve the purposes of enhancing fluidity and solving the problems of toner dusting and the like. If $k_1$ is larger than 0.64, the reproducibility of half tone images will be lowered, and/or there will arise problems such as toner component adhesion to the photoconductor and fogging due to repetition of copy. In view of such unfavorable possibilities, a preferred range of $k_1$ is from 0.575 to 0.63. If the angle of repose X is smaller than 28°, the problems of toner dusting and fogging cannot be fully solved, and if the angle is larger than 38°, tone reproduction will be low and reproduction of half tone images will also be low. In view of these facts, a preferred range of repose angles is from 29° to 37°, more preferably from 30° to 36°.

In relation (3), if $k_2$ is smaller than 0.135, the developing performance of the toner under ambient conditions of low temperature/low humidity is lowered, resulting in image quality degradation. If $k_2$ is larger than 0.158, it is necessary to add a fluidizing agent in a large quantity and, as a result, such agent will adhere to the surface of the photoconductor at the time of blade cleaning, and the adhered material may act as a nucleus to induce other toner component into adhesion. Also, when copy is repeated, such agent will adhere to the surface of the carrier (become spent), with the result that the charging function of the carrier will be lowered. In view of these points, a preferred range of $k_2$ is from 0.138 to 0.156, more preferably from 0.141 to 0.155.

If the volume-mean particle size is larger than 10 μm, high-precision image reproduction is hampered. If the volume-mean particle size is smaller than 3 μm, handling (cleaning and charge control) in the interior of the image forming apparatus is rendered difficult.

The above noted relations are established on the basis of various corrections made by considering the matter of toner particle size in conjunction with the relationship between apparent specific gravity of looseness and angle of repose which was discovered on the basis of the results of experiments which will be described hereinafter.

In the present invention, the apparent specific gravity of looseness and the angle of repose can be controlled within above mentioned ranges by using at least two kinds of inorganic fine particles to be externally added to the toner particles and by selecting inorganic fine particles of such two kinds for use. Preferred combinations with respect to negatively chargeable toners will be explained hereinbelow. It is to be understood, however, that the invention is not intended to be limited to the combinations shown.

A most preferred form of negatively chargeable toner is such that first and second inorganic fine particles to be described hereinafter are added to and mixed with the negatively chargeable toner.

The first inorganic fine particles are inorganic particles having a number mean particle size range of from 10 to 30 nm which are effective for controlling the apparent specific gravity within the above described range. By adding such inorganic fine particles to the toner particles for mixture therewith is it possible to impart high fluidity to the toner. If the mean particle size is less than 10 nm, the inorganic fine particles are liable to be buried into toner particles with the result that the powder characteristics of the toner are liable to variations. If the mean particle size is more than 30 nm, the effect of the inorganic fine particles for fluidity improvement is reduced.

For the first inorganic fine particles, it is desirable to use those having more negative chargeability on the negative side in relation to the negatively chargeable toner particles. The addition of such fine particles provides the effect of improving the negatively charging characteristic of the toner and the effect of enhancing the uniformity of the behavior (adhesion) of second inorganic fine particles relative to the toner particles thereby to substantially enhance the effect of addition of the second inorganic fine particles.

A quantity of addition of the first inorganic fine particles to the toner particles is from 0.3 to 3.0% by weight, preferably from 0.5 to 2.5% by weight, more preferably from 0.8 to 2.0% by weight. If the addition is less than 0.3% by weight, the effect of the addition is insufficient. If the addition is more than 3% by weight, toner dusting and/or fogging is likely to occur at the time of repetition of copy, and there may arise the problem of toner component adhesion to the photoconductor.

Preferably, the first inorganic fine particles are surface-treated with a hydrophobicizing agent. More specifically, it is preferable to use those having a hydrophobicity of 50 or more. By using such hydrophobicized inorganic fine particles, it is possible to prevent any drop in the toner charge under high temperature and high humidity conditions.

Hydrophobicizing treatment may be carried out using such a hydrophobicizing method and hydrophobicizing agent as earlier described. The same concept of hydrophobic degree as earlier described is applicable in the present case as well.

For such first inorganic fine particles, silica, titania, alumina and the like may be used alone or in combination of two or more kinds. In particular, silica and titania are preferred.

For the second inorganic fine particles, inorganic fine particles having a number-mean particle size of from 100 to 1000 nm, preferably from 100 to 800 nm are used. By using such second inorganic fine particles in combination with the first inorganic fine particles it is possible to extend the angle of repose while maintaining high fluidity due to the addition of the first inorganic fine particles, and thus to eliminate the trouble of toner dusting and fogging and extend the life of the developer. The reason for this has not definitely been found, but conceivably the electrostatic linkage between individual toner particles is strengthened by the presence of second inorganic fine particles as attached to the surface of negatively chargeable toner particles under the effect of their particle size, which in turn contributes to extending the angle of repose. Another conceivable explanation may be that despite the fact that when the angle of repose of a toner is extended, the apparent specific gravity of looseness generally tends to be lowered, the selection of a suitable combination of first and second inorganic fine particles makes it possible to obtain a toner having a larger angle of repose and a larger apparent specific gravity of looseness. If the mean particle size of second inorganic fine particles is less than 100 nm, the effect of such fine particles is insufficient to increase the angle of repose. If the mean particle size is more than 1000 nm, the coverage of the second inorganic fine particles relative to toner particles and their adhesion to toner particles are lowered to a level insufficient to exhibit their expected performance. Further, where repetitive image forming is carried out, the photoconductor is liable to be damaged during a blade cleaning operation, or during press transfer by the transfer drum in a full-color image forming apparatus or the like.

From these view points, it is desirable to use second inorganic fine particles which are capable of charging on the positive side in relation to negatively chargeable toner particles. Where the toner is used as a two-component developer, it is desirable that second inorganic fine particles should have more positive chargeability than carrier particles. By using such second inorganic fine particles it is expected that the second inorganic fine particles can allow the toner particles to charge negatively in the event that an external additive becomes spent on the carrier during repetition of copy operation, so that the trouble of toner dusting and/or fogging due to a drop in the quantity of toner charge can be eliminated whereby the life of the developer can be extended. Preferably, second inorganic fine particles are mixed with the toner particles after the first inorganic fine particles are mixed with the toner particles.

Since the second inorganic fine particles serve to reduce the quantity of first inorganic fine particles which pass through the blade during a blade cleaning operation, the trouble of such particles adhering to the surface of the photoconductor after slipping through the blade can be solved which may otherwise induce other toner component to adhere to them and which may thus lead to image noise.

For such second inorganic fine particles, fine particles of such materials as silica, titania, alumina, barium titanate, magnesium titanate, calcium titanate, strontium titanate, chrome oxide, cerium oxide, magnesium oxide, and zirconium oxide may be used alone or in combination of two or more kinds. These fine particles may be surface treated with, for example, an aminosilane coupling agent and an amino-silicone oil to adjust its chargeability. Since the second inorganic fine particles are of relatively large particle size with a number-mean particle size on the order of from 100 to 1000 nm, they may be particles which exist as primary particles having a mean particle size within the above mentioned range, or particles which exist in the form of aggregates (e.g., sintered aggregates) of primary particles and have a mean particle size within the above mentioned range, or particles which comprise primary particles and primary particle aggregates present in mixture and have a mean particle size within the above mentioned range. Also, for the second inorganic fine particles, are preferred fine particles of strontium titanate having charging characteristic as above mentioned, and in particular, those having a number-mean particle size of from 100 to 800 nm and including not more than 20 number % of particles of 1000 nm or more.

Second inorganic fine particles are added to the toner particles in the proportion of from 0.3 to 5.0% by weight, preferably from 0.5 to 3.0% by weight. If the quantity of addition is less than 0.3% by weight, the effect of such addition is insufficient, and if the quantity of addition is more than 5% by weight, the charging capability of the toner is adversely affected.

Preferred forms of first and second inorganic fine particles for use with the negatively chargeable toner have now been described. It is to be understood, however, that the present invention is not intended to be limited to such forms. Where the toner particles are negatively chargeable full color toner particles, it is desirable from the standpoint of environmental stability to add, in addition to the above described first and second inorganic fine particles, third inorganic fine particles to be described hereinbelow.

For the third inorganic fine particles, inorganic fine particles having a number-mean particle size of from 30 to 90 nm, preferably from 35 to 80 nm are used. Such inorganic fine particles act to enhance environmental stability (in particular, prevention of any image density drop in a low-temperature/low humidity environment). Also, such inorganic fine particles act to prevent first inorganic fine particles from being buried in toner particles in the course of repetition of copy. If the mean particle size is more than 90 nm, the coverage of the third inorganic fine particles relative to the toner particles is so small that the effect of such fine particles is insufficient to allow the fine particles exhibit their expected function. If the mean particle size is less than 30 nm, there may occur the trouble of particles being buried in toner particles due to some stress caused within the developing apparatus during repetition of copy.

For such third inorganic fine particles, fine particles of such materials as silica, titania, alumina, barium titanate, magnesium titanate, calcium titanate, strontium titanate, chrome oxide, cerium oxide, magnesium oxide, and zirconium oxide may be used alone or in combination of two or more kinds. In particular, it is desirable to use titania fine particles from the view point of environmental stability. For the titania fine particles, anatase-type titania, rutile-type titania, and amorphous titania may be used, but anatase-type titania is preferred.

It is desirable that third inorganic fine particles have been surface treated with a hydrophobic agent. By using such hydrophobicized third inorganic fine particles it is possible to enhance environmental stability. Where titania fine particles, used as third inorganic fine particles, are hydrophobically treated, the hydrophobicizing treatment is carried out preferably in an aqueous system in order to ensure uniformity of surface treatment of the titania by a hydrophobicizing agent and the titania particles being prevented from aggregation.

The quantity of addition of third inorganic fine particles to the toner particles is in the range of 0.1 to 3.0% by weight, preferably from 0.3 to 2.0% by weight. If the quantity of addition is less than 0.1% by weight, the effect of such addition is insufficient, and if the quantity is more than 3% by weight, there may occur the trouble of toner component adhesion to the photoconductor.

The third inorganic fine particles are preferably used in such a way that a combined quantity of addition of the third and first inorganic particles is within the range of from 1.0 to 3.0% by weight. This is desirable from the standpoint of preventing the trouble of voids due to toner aggregation.

For manufacture of toner particles with additives externally added thereto, any method known as such in the prior art may be employed. For example, toner particles can be manufacture by a kneading and pulverizing method, a spray dry method, a suspension-polymerization method, and an interface polymerization method (capsule toner). Such toner particles may contain any desired additives, other than binder resin and colorant, such as charge control agent, magnetic powder, and wax.

For the binder resin to be used in the toner of the present invention, resins known in the art may be used including, for example, styrenic resins, acrylic resins such as alkyl acrylate and alkyl methacrylate, styrene-acryl copolymer resins, polyester resins, epoxy resins, silicon resins, olefinic resins, and amide resins. These resins may be used alone or in combination.

In the present invention, the binder resin for use in full-color toners, such as cyan toner, magenta toner, yellow toner, and black toner, is a polyester resin or epoxy resin having a number-mean molecular weight (Mn) of from 3000 to 6000, preferably from 3500 to 5500, the ratio of weight-mean molecular weight (Mw) to number-mean molecular weight ratio (Mn), i.e., Mw/Mn, being from 2 to 6, preferably, from 2.5 to 5.5, a glass transition point of from 50° to 70° C., preferably from 55° to 65° C., and a softening point of from 90° to 110° C., preferably from 90° to 105° C. Such polyester resin or epoxy resin is suitable for use as a binder resin for a negatively chargeable toner.

If the number-mean molecular weight of the binder resin is less than 3000, a trouble may occur such that when a full-color solid copied image is bent, an image portion peels off so that the image is rendered defective (which means poor flexural fixability). If the number-mean molecular weight is more than 6000, the hot meltability of the toner during a fixing operation is reduced, resulting in a low fixing strength. If Mw/Mn is less than 2, a high-temperature offset is likely to occur. If Mw/Mn is more than 6, the sharp melt characteristic of the toner during a fixing operation is lowered so that light-transmittance of the toner, as well as color mixability of the toner in the case of full color image formation, is reduced. If the glass transition point is less than 50° C., the toner has only insufficient heat resistance with the result that the toner is liable to aggregate while in storage. If the glass transition point is more than 75° C., the fixability of the toner is lowered, and color mixability of the toner at the time of full color image formation is also lowered. If the softening point is less than 90° C., high-temperature offsetting is likely to occur, whereas if it is more than 110° C., the performance characteristics of the toner are lowered in fixing strength, light transmission, color mixability, and full-color image gloss.

Useful polyester resins are those containing an etherified diphenol as an alcohol component, and an aromatic dicarboxylic acid as a acid component.

Examples of etherified diphenols include polyoxypropylene (2, 2)-2, 2-bis (4-hydroxyphenyl) propane, and polyoxyethylene (2)-2, 2-bis (4-hydroxyphenyl) propane.

It is possible to use, together with such etherified diphenol, for example, diols, such as ethylene glycol, diethylene glycol, triethylene glycol, 1, 2-propylene glycol, 1, 3-propylene glycol, 1, 4-butanediol, and neopentyl glycol; sorbitol, 1, 2, 3, 6-hexanetetorol, 1, 4-sorbitan, pentaerythritol, dipentaerythritol, tripentaerythritol, 1, 2, 4-butanetriol, 1, 2, 5-pentanetriol, glycerol, 2-methylpropanetriol, 2-methyl-1, 2, 4-butanetriol, trimethylolethane, trimethylolpropane, and 1, 3, 5-trihydroxymethylbenzene.

Useful aromatic dicarboxylic acids include terephthalic acid and isophthalic acid; and anhydrides thereof, or lower alkylesters of such acids.

Aliphatic dicarboxylic acids may also be used, including, for example, fumaric acid, maleic acid, succinic acid, alkyl or alkenyl succinic acid having 4 to 18 carbon atoms; and anhydrides thereof, or lower alkylesters of such acids.

Also, for purposes of adjusting the acid value of the polyester resin and enhancing the resin strength, it is possible to use polyvalent carboxylic acids, such as 1, 2, 4-benzenetricarboxylic acid (trimellitic acid), 1, 2, 5-benzenetricarboxylic acid, 2, 5, 7-naphthalenetricarboxylic acid), 1, 2, 4-naphthalene tricarboxylic acid, 1, 2, 5-hexanetricarboxylic acid, 1, 3-dicarboxyl-methyl-2-methylene carboxypropane, 1, 2, 4-cyclohexanetricarboxylic acid, tetra(methylenecarboxyl) methane, 1, 2, 7, 8-octane tetracarboxylic acid, pyromellitic acid, and anhydrides thereof, or lower alkylesters of such acids, in a small quantity range which is not detrimental to the light transmission characteristic of the toner. Where such acid is used with respect to a black toner, no particular consideration is required for its effect on the light transmission characteristic.

For the colorants to be used in the toner of the invention, those known in the art may be used without any particular limitation.

For use in color toners, the colorants are desirably such that they have been previously subjected to a master batch treatment or flushing treatment for dispersibility improvement. The colorant content of the toner is preferably from 2 to 15 parts by weight relative to 100 parts by weight of the binder resin.

The toner of the invention may include, in addition to the colorant, a charge control agent, magnetic powder, wax and the like as desired.

For the charge control agent, those known as such in the art may be used without being limited to any particular ones. Charge control agents for use in color toners are colorless, white or light color charge control agents which are not detrimental to the color toner in respect of its tone and light transmission characteristic. For example, charge control agents, such as salicylic metal complex, e.g., a zinc complex of salicylic acid derivatives, calix arene compounds, organic boron compounds, and fluorine-containing quaternary ammonium salt compounds, are preferably used. For the salicylic metal complex, those described in, for example, Japanese Patent Application Laid-Open Sho. 53-127726 and Sho. 62-145255 may be used. For the calix arene compound, those described in, for example, Japanese Patent Application Laid-Open Hei. 2-201378 may be used. For the organic boron compound, those described in, for example, Japanese Patent Application Laid-Open Hei. 2-221967 may be used. For the fluorine-containing quaternary ammonium salt compound, those described in, for example, Japanese Patent Application Laid-Open Hei. 3-1162 may be used.

Where such charge control agent is used as an additive, the agent is used in a quantity range of from 0.1 to 10 parts by weight, preferably from 0.5 to 5.0 parts by weight, relative to 100 parts by weight of the binder resin.

From the standpoint of high precision image reproduction, it is desirable that the toner of the invention should have its volume-mean particle size adjusted to a range of from 5 to 10 μm, preferably from 6 to 9 μm.

The toner of the invention may be used as a two-component developing toner in which the toner is used in mixture with a carrier, or as a one-component developing toner in which no carrier is used.

Where a carrier is used in combination with the toner of the invention, those known as two-component developing carriers in the art may be used including, for example, a carrier comprised of magnetic particles of iron, ferrite or the like, a resin coat carrier comprising such magnetic particles coated with resin, or a binder type carrier comprising a magnetic fine particles dispersed in a binder resin. Considering the problem of toner spent or the like, it is preferable to use a resin coat carrier of using, as the coating resin, a silicone resin, a copolymer resin (graft copolymer resin) of organopolysiloxane and a vinyl monomer, or a polyester resin, or a binder type carrier using a polyester resin as the binder resin. In particular, a carrier which is coated with a resin produced by reacting isocyanate with a copolymer resin of organopolysiloxane and a vinyl monomer is preferred for use from the view points of chargeability relative to a negatively chargeable toner, permanence, environmental stability, and anti-spent behavior. For the vinyl monomer, it is required that the monomer should have a substituent, such as hydroxyl group, which is reactive with isocyanate. From the view points of high-quality image and carrier fog or carrier deposit prevention, the carrier is preferably such that it has a volume-mean particle size of from 20 to 100 μm, preferably from 30 to 80 μm.

EXAMPLES

The following examples are given to further illustrate the invention. It is to be understood, however, that the invention is not intended to be limited to the specific examples.

Production of Polyester Resin

Into a 2-liter, 4-necked flask, fitted with a reflux condenser, a water separator, a nitrogen gas induction pipe, a thermometer, and a stirrer, and placed in a mantle heater, were charged polyoxypropylene (2, 2)-2, 2-bis(4-hydroxyphenyl) propane (PO), polyoxyethylene (2, 0)-2, 2-bis(4-hydroxyphenyl) propane (EO), fumaric acid (FA) and terephthalic acid (TPA) in a molar ratio of 5:5:5:4. The materials were heated and stirred into reaction while nitrogen was introduced into the flask. The progress of reaction was followed while acid value measurement was made, and the reaction was ended when a predetermined acid value was reached. Thus, a polyester resin was obtained which had a number-mean molecular weight Mn of 4800, a ratio of Mw/Mn of weight-mean molecular weight Mw to number-mean molecular weight Mn of 4.0, a glass transition point of 58° C., and a softening point of 100° C.

Measurement of number-mean molecular weight and weight-mean molecular weight was made by using gel permeation chromatography (instrument used: type 807-IT, manufactured by Nihon Bunko Kogyo K.K.), with tetrahydrofuran, as a carrier solvent, made to flow at a rate of 1 kg/cm$^3$ through the column kept at 40° C. Sample 30 mg, for measurement was dissolved in 20 ml of tetrahydrofuran, and the resulting solution was introduced into the column along with the carrier solvent. The number-mean molecular weight and weight-mean molecular weight were determined in terms of polystyrene.

Measurement of glass transition point was made with 10 mg of sample by using a differential scanning calorimeter (DSC-200, manufactured by Seiko Denshi K.K.), at a heating rate of 10° C./min, with alumina used as a reference. A shoulder value for a main absorption peak is taken as the glass transition point.

Measurement of softening point was made with 1.0 g of sample by using a flow tester (CFT-500, manufactured by Shimadzu Seisakusyo K.K.), along with a die of 1.00 mm pore diameter×1.00 mm pore length under the conditions of: temperature rise rate, 3.0 ° C./min; preheating time, 180 sec; load, 30 kg; and measuring temperature range, 60° to 140° C. The temperature at which ½ of the sample flowed out was taken as the softening point.

Preparation of Toner Particles A

The above described polyester resin and a magenta pigment (C. I. pigment red 184) were charged into a press kneader to a resin to pigment weight ratio of 7:3 and were kneaded together. The kneaded mixture was ground to obtain a pigment master batch.

Ninety three parts by weight of the polyester resin, 10 parts by weight of the pigment master batch, and 2 parts by weight of a charge control agent (zinc salicylate complex: E-84, made by Orient Kagaku Kogyo K.K.) were mixed by a Henschel mixer. The mixture was then kneaded by a twin-screw extruding-kneader. After having been cooled, the kneaded mixture was subjected to coarse milling by a feather mill, then to pulverization by a jet mill. The resulting particles were classified and, as a result, toner particles A having a volume-mean particle size of 8.5 μm were obtained. The quantity of blow off charge of the toner particles relative to iron powder was −53 μC/g. In place of the iron powder, a carrier obtained in the example of carrier preparation to be described hereinafter was used in measuring the quantity of blow-off charge. The measurement showed a blow-off charge quantity of −20 μC/g.

The measurement of blow-off charge quantity was made in the following way according to the blow-off method. Twenty five gram of reference iron carrier (Z150/250, produced by Powdertech K.K.) and 50 mg of sample, placed in a 25 cc polybottle, were mixed together by a turbler mixer for 1 minute. Then, 0.1 g of sample was placed in a measuring container having a 400 mesh stainless steel screen, and measurement was made by a blow-off charge measuring device (TB-200, manufactured by Toshiba Chemical K.K.) and under the conditions of: nitrogen gas flow rate, 1.0 kgf/cm$^2$, and inflow time, 60 sec.

Preparation of Toner particles B

One hundred parts by weight of the polyester resin, 3 parts by weight of carbon black (Morgal L, produced by Cabot K.K.), and 2 parts by weight of a charge control agent (zinc salicylate complex: E-84, made by Orient Kagaku Kogyo K.K.) were mixed by a Henschel mixer. The mixture was then kneaded by a twin-screw extruding kneader. After being cooled, the kneaded mixture was subjected to coarse milling by a feather mill, then to pulverization by a jet mill. The resulting particles were classified and, as a result, toner particles B having a volume-mean particle size of 8.5 μm were obtained. The quantity of blow off charge of the toner particles relative to iron powder was −48 μC/g. In place of the iron powder, a carrier obtained in the example of carrier preparation to be described hereinafter was used in measuring the quantity of blow-off charge. The blow-off charge quantity was −18 μC/g.

Example of Carrier Preparation

One hundred parts by weight of methyl ethyl ketone were charged into a 500 ml-flask equipped with a stirrer, a thermometer, a nitrogen induction pipe, and a dropping device. Separately, a solution obtained by dissolving 36.7 parts by weight of methyl methacrylate, 5.1 parts by weight of 2-hydroxyethyl methacrylate, 58.2 parts by weight of 3-methacryloxypropyl tris(trimethylsiloxy) silane, and 1 part by weight of 1, 1'-azobis(cyclohexane-1-carbonitrile in 100 parts by weight of methyl ethyl ketone was trickled down into a reaction vessel over 2 hours and was allowed to be aged for 5 hours.

To the resultant resin was added, as a cross-linking agent, isophorone diisocyanate/trimethylolpropane adduct (IPD/TMP: NCO %=6.1%) to an OH/NCO molar ratio of 1/1. The resin solution was diluted with methyl ethyl ketone and, as a result, a coat resin solution having a solid content of 3% by weight was obtained.

Calcined ferrite powder F-300 (volume-mean particle size: 50 μm; produced by Powdertech K.K.) was used as a core material, and the coat resin solution was coated on the core material by a SPIRA COTA (manufactured by Okada Seiko K.K.) so that the resin coverage relative to the core material was 1.5% by weight, the coating being then dried. The carrier thus obtained was allowed to stand in a hot-air circulation type oven at 160° C. for 1 hour for being aged. After being cooled, the ferrite powder bulk was disintegrated by a sieve shaking machine fitted with a screen mesh having 106 μm openings and 75 μm openings. Thus, a resin coated carrier was obtained.

Examples of First Invention

Example I-1

Toner particles A obtained as above described were mixed with 1.0% by weight of hydrophobic silica fine particles (silica fine particles with a number-mean particle size of 15 nm; #130, manufactured by Nippon Aerosil K.K.; surface treated with hexamethyl disilazane; hydrophobicity 60) in a Henschel mixer. Then, 1.5% by weight of strontium titanate fine particles (number-mean particle size, 350 nm; content of particles of 1000 nm or more, 0 number %; content of particles of 800 nm or more, 0 number %; number-mean particle size of primary particles forming an aggregate, 80 nm) were introduced into the mixer for mixture with them. Mixed particles were sifted through a 200-mesh circular vibrating screen. Thus, toner 1 was obtained. An electromicroscopic photo observation, 5000× magnification, of the toner indicated that the number of strontium titanate fine particles of 200 nm or more present as attached to one toner particle was 14.9 on the average.

Comparative Example I-1

Toner 2 was obtained in the same way as in Example I-1, except that strontium titanate fine particles were not mixed.

Comparative Example I-2

Toner 3 was obtained in the same way as in Example I-1, except that strontium titanate fine particles were used which included 50 number % of particles having a number-mean particle size range of 1000 nm and above, and 70 number % of particles having a number-mean particle size range of 800 nm and above, and in which primary particles forming an aggregate had a number-mean particle size of 300 nm. In this toner, the number of strontium titanate fine particles of 200 nm or more present as attached to one toner particle was 1.6 on the average.

Preparation of Developer

A developer was prepared by mixing respective toner 1, 2, 3 with the carrier obtained in the foregoing example of carrier preparation so that the proportion of the toner was 7% by weight. Five thousands copies of B/W 15% image were made with the developer by using a digital full color copying machine CF900 (manufactured by Minolta K.K.) under N/N environmental conditions (25° C., 50%). Evaluation was made on the following items. Results are shown in Table 1.

Toner Component Adhesion to Photoconductor (BS)

Evaluations were made on the basis of post-copying visual and electromicroscopic observations of the photoconductor surface, and also on the basis of visual observation of copied image after durability test with respect to copy. Where no adhesion of externally added material was found through electromicroscopic observation, the toner was rated ⊙. Where adhesion of externally added material on the photoconductor was found through electromicroscopic observation, but no such adhesion was visually found and there was no image noise occurrence, the toner was rated ○. Where adhesion of externally added material and toner component were visually observed on the photoconductor, but there was no noise occurrence, the toner was rated Δ. Where adhesion of externally added material and toner component were observed on the photoconductor and such adhesion was reflected as noise on the image, the toner was rated x.

Evaluation of Dusting after Durability Test with Respect to Copy

When the developing apparatus, with the photoconductor removed after durability test with respect to copy, was driven, there was no toner flying from the developing sleeve, and any blank portion of the image obtained was free from fogging; and there was no stain or smear caused to the interior of the apparatus, in which case the toner was rated ⊙. Where some toner flying from the sleeve was found, but there was no stain or smear caused to the interior of the apparatus, the toner was rated ○. Where some toner flying from the sleeve and some internal stain or smear were observed, but no image fogging was found, the toner was rated Δ. Where toner flying from the sleeve and internal smearing were found, the toner was rated x.

Damage to Photoconductor

Organic photoconductor surface was visually evaluated after durability test with respect to copy. Where no damage was found on the photoconductor surface, the toner was rated ○. Where the conductor surface appeared lightly cloudy, the toner was rated Δ. Where some scratch was found on the photoconductor surface, the toner was rated x.

Aggregation Noise (voids in copied images)

Five thousands copies of B/W 15% image were made with each developer by using a digital full color copying machine CF900 (manufactured by Minolta K.K.) under N/N environmental conditions (25° C., 50%). After the durability test, a full solid image (ID=1.2) was copied on 3 sheets of A3 paper. Evaluation was made on the following criteria and average value of the three sheets was taken as the result of the evaluation. The evaluation criteria are as follows. Where an image irregularity (void) which was as large as 2 $mm^2$ and less than ½ of ID of the solid image was present in the solid copied image, the developer was rated x. Where no void was found, but an aggregate nucleus of the order of 0.3 μm was observed in the image, and where 3 spots or more at which the image density was somewhat lower were found around the nucleus in the image, the developer was rated Δ. Where such spots were less than 3 in number, the developer was rated ○. Where no such spot was found, the developer was rated ◎.

Thermal Storage Stability

Where 5 g of toner, placed in a glass bottle, was stored for 24 hours at 50° C., if a toner aggregation did occur, the toner was rated x; slight aggregation occurred but involved no problem from the practical point of view, in which case the toner was rated Δ; and where no toner aggregation was found, the toner was rated ○.

TABLE 1

| | Toner component adhesion | Toner dust | Photo-conductor damage | Aggregation noise | Thermal storage stability |
|---|---|---|---|---|---|
| Example I-1 | ◎ | ○ | ○ | ○ | ○ |
| Comparative Example I-1 | Δ | x | ○ | Δ | ○ |
| Comparative Example I-2 | ○ | x | x | Δ | ○ |

Example I-2

Toner particles A were mixed with 0.7% by weight of hydrophobic silica fine particles of the same type as used in Example I-1 in a Henschel mixer. Then, for mixture with them, 0.7% by weight of hydrophobic titania fine particles (anatase-type titania with a number-mean particle size of 50 nm, surface treated with n-butyltrimethoxy silane; hydrophobicity, 55), and 1.5% by weight of strontium titanate fine particles of the same type as used in Example I-1 were introduced into the mixer. Mixed particles were sifted through a 200-mesh circular vibrating screen. Thus, toner 4 was obtained. In this toner, the number of strontium titanate fine particles of 200 nm or more present as attached to one toner particle was 15.6 on the average.

Example I-3

Toner 5 was obtained in the same way as in Example I-2, except that the quantity of addition of strontium titanate fine particles was changed to 0.8% by weight. In this toner, the number of strontium titanate fine particles of 200 nm or more present as attached to one toner particle was 9.2 on the average.

Example I-4

Toner 6 was obtained in the same way as in Example I-2, except that the quantity of addition of strontium titanate fine particles was changed to 1.8% by weight. In this toner, the number of strontium titanate fine particles of 200 nm or more present as attached to one toner particle was 18.1 on the average.

Example I-5

Toner 7 was obtained in the same way as in Example I-2, except that the strontium titanate fine particles used were those including particles having a number-mean particle size of 500 nm in which the proportion of particles of 1000 nm or more was 5% by number and the proportion of particles of 800 nm or more was 10% by number, and in which primary particles forming an aggregate had a number-mean particle size of 100 nm. In this toner, the number of strontium titanate fine particles of 200 nm or more present as attached to one toner particle was 14.3 on the average.

Comparative Example I-3

Toner 8 was obtained in the same way as in Example I-2 except that strontium titanate fine particles were not added.

Comparative Example I-4

Toner 9 was obtained in the same way as in Comparative Example I-3 except that 0.4% by weight of silica fine particles and 0.4% by weight of titania fine particles were added.

Comparative Example I-5

Toner 10 was obtained in the same way as in Example I-2, except that strontium titanate fine particles identical with those used in Comparative Example I-2 were used. In this toner, the number of strontium titanate fine particles of 200 nm or more present as attached to one toner particle was 1.2 on the average.

Preparation of Developer

A developer was prepared by mixing each of the toners 4 to 10 with the carrier obtained in above described preparation example so that the proportion of the toner was 7% by weight. The developer was evaluated on the above described evaluation items and also on the following items. The results are shown in Table 2.

Environmental Stability

A B/W 15% image was copied with each developer by using CF 900 in an L/L environmental conditions (10° C., 15%). The image density of the image obtained was measured by using a Macbeth reflection densitometer RD-900. Where the image density was 1.2 or more, rating was ○; where the image density was not less than 1.0 but less than 1.2, the developer was rated Δ; and where the image density was less than 1.0, the developer was rated x.

Five thousands copies of a B/W 15% image were made by using CF900 under H/H conditions (30°, 85%). Blank portions of the image obtained were visually evaluated. Where no fog was found in the image, rated ○; where some fog was present but there was no problem from practical points of view, rated Δ; and where many fogs were present, involving problems from practical view points, the developer was rated x.

TABLE 2

| | Toner component | Toner dust | Photo-conductor damage | Aggregation noise | Environmental stability H/H | Environmental stability L/L | Thermal storage stability |
|---|---|---|---|---|---|---|---|
| Example I-2 | ◎ | ○ | ○ | ○ | ○ | ○ | ○ |
| Example I-3 | ○ | ○ | ○ | ○ | ○ | ○ | ○ |
| Example I-4 | ◎ | ○ | ○ | ◎ | ○ | ○ | ○ |
| Example I-5 | ◎ | ○ | ○ | ○ | ○ | ○ | ○ |
| Comparative Example I-3 | x | x | ○ | ○ | ○ | ○ | ○ |
| Comparative Example I-4 | ○ | ○ | ○ | x | ○ | ○ | x |
| Comparative Example I-5 | ○ | x | x | ○ | ○ | ○ | ○ |

Examples of Second Invention

Preparation of Toner

Toner particles obtained as above described were mixed with external additives shown in Table 3 which were added in such proportions relative to toner particles as shown in Table 4. First, the toner particles were mixed with inorganic fine particles 1 in a Henschel mixer. Then, other inorganic fine particles were introduced into the mixer for further mixing. Then, the mixed particles were sifted through a 200-mesh circular vibrating screen to provide a toner of respective example. With respect to each toner thus obtained, apparent specific gravity of looseness, angle of repose, and k1 are shown in Table 4, and the relationship between apparent specific gravity and angle of looseness is shown in FIG. 1. Measurement of apparent specific gravity of looseness and angle of repose was carried out by means of a powder tester, type PT-E (manufactured by Hosokawa Micron K. K.).

TABLE 3

| | Type of Inorganic Fine Particles |
|---|---|
| 1 | #130, number-mean particle size 15 nm (made by Nippon Aerosil K.K.), surface-treated with hexamethyl disilazane; hydrophobicity 60; blow-off charge −1138 μC/g |
| 2 | Anatase-type titania, number-mean particle size 15 nm, surface-treated with n-butyl trimethoxy silane; hydrophobicity 60; blow-off charge −71 μC/g |
| 3 | Anatase-type titania, number-mean particle size 50 nm, surface-treated with n-butyl trimethoxy silane; hydrophobicity 55; blow-off charge −129 μC/g |
| 4 | Strontium titanate, number-mean particle size 350 nm, with 0 number % of particles of 1000 nm or more; blow-off charge +16 μC/g |
| 5 | Rutile-type titania, number-mean particle size 2000 nm; blow-off charge −15 μC/g |
| 6 | Strontium titanate, number-mean particle size 1000 nm, with 50 number % of particles of 1000 nm or more; blow-off charge −4 μC/g |

TABLE 4

| | | | Inorganic fine particle | | | | | | | | | | |
|---|---|---|---|---|---|---|---|---|---|---|---|---|---|
| | | Toner particle | Type | Qty. wt % | Type | Qty. wt % | Type | Qty. wt % | Type | Qty. wt % | Apparent specific gravity of looseness g/cc | Angle of repose (°) | $k_1$ |
| Ex. | II-1 | A | 1 | 0.70 | 3 | 0.50 | 4 | 1.80 | | | 0.429 | 33.2 | 0.595 |
| | II-2 | A | 1 | 0.60 | 3 | 0.60 | 4 | 1.80 | | | 0.424 | 34.8 | 0.598 |
| | II-3 | A | 1 | 0.75 | 3 | 0.75 | 4 | 0.80 | | | 0.439 | 30.3 | 0.591 |
| | II-4 | A | 1 | 0.75 | 3 | 0.75 | 4 | 1.10 | | | 0.441 | 31.4 | 0.598 |
| | II-5 | A | 1 | 0.75 | 3 | 0.75 | 4 | 1.50 | | | 0.428 | 34.8 | 0.602 |
| | II-6 | A | 1 | 0.75 | 3 | 0.75 | 4 | 1.80 | | | 0.432 | 32.7 | 0.596 |
| | II-7 | B | 1 | 0.60 | 3 | 0.60 | 4 | 1.50 | | | 0.417 | 34.4 | 0.589 |
| | II-8 | B | 1 | 0.39 | 2 | 0.56 | 4 | 1.50 | | | 0.428 | 29.8 | 0.577 |
| | II-9 | B | 1 | 0.60 | 2 | 0.60 | 4 | 1.50 | | | 0.434 | 29.1 | 0.580 |
| | II-10 | B | 1 | 0.60 | 2 | 0.30 | 3 | 0.30 | 4 | 1.50 | 0.428 | 32.1 | 0.589 |
| Com. | II-1 | A | 1 | 0.50 | 2 | 0.70 | | | | | 0.448 | 20.6 | 0.537 |
| Ex. | II-2 | A | 1 | 0.34 | 2 | 0.56 | | | | | 0.423 | 23.6 | 0.541 |
| | II-3 | A | 1 | 0.40 | 3 | 0.80 | | | | | 0.422 | 26.3 | 0.554 |
| | II-4 | A | 1 | 0.30 | 3 | 0.60 | | | | | 0.403 | 29.2 | 0.549 |
| | II-5 | A | 1 | 0.20 | 3 | 0.40 | | | | | 0.387 | 33.0 | 0.552 |
| | II-6 | A | 1 | 0.75 | 3 | 0.75 | | | | | 0.442 | 22.2 | 0.553 |
| | II-7 | A | 1 | 0.75 | 3 | 0.75 | 4 | 0.50 | | | 0.445 | 25.6 | 0.573 |
| | II-8 | A | 1 | 0.75 | 3 | 0.75 | 5 | 0.50 | | | 0.448 | 26.0 | 0.578 |
| | II-9 | A | 1 | 0.75 | 3 | 0.75 | 5 | 0.80 | | | 0.446 | 27.1 | 0.582 |
| | II-10 | A | 1 | 0.75 | 3 | 0.75 | 5 | 1.10 | | | 0.447 | 26.8 | 0.581 |
| | II-11 | B | 1 | 0.60 | 2 | 0.30 | 3 | 0.30 | | | 0.441 | 22.4 | 0.553 |
| | II-12 | B | 1 | 0.39 | 2 | 0.56 | 4 | 0.50 | | | 0.433 | 23.1 | 0.549 |
| | II-13 | B | 1 | 0.60 | 2 | 0.60 | 6 | 1.50 | | | 0.440 | 25.9 | 0.570 |

A developer was prepared by mixing each of the toners with the carrier obtained in the above described example of carrier preparation in such a way that the proportion of the toner was 7% by weight. With respect to the developer, evaluation was made of aggregation noise (voids), environmental stability, toner component adhesion to photoconductor surface (BS), and dusting in the same way as above described. Evaluation of photoconductor damage was made in the following manner.

Visual evaluation and image evaluation were carried out of the surface of the photoconductor after durability test with respect to copy. Where neither damage nor line image was present on the surface of the photoconductor, rating was ⊙; where the photoconductor surface appeared lightly cloudy, but no line image was found, rating was ○; where some scratch was found on the photoconductor surface and some line image was observed, but such was considered tolerable from the practical points of view, rating was Δ; and where some scratch(es) and an line image were found on the photoconductor surface, rating was x.

The evaluation results are shown in Table 5.

TABLE 5

| | Aggregation noise | Environmental stability H/H | Environmental stability L/L | Toner component adhesion | Thermal storage stability | Toner dust | Photo-conductor damage |
|---|---|---|---|---|---|---|---|
| Ex. II-1 | ⊙ | ○ | ○ | ⊙ | ○ | ⊙ | ⊙ |
| Ex. II-2 | ⊙ | ○ | ○ | ⊙ | ○ | ⊙ | ⊙ |
| Ex. II-3 | ○ | ○ | ○ | ○ | ○ | Δ | ○ |
| Ex. II-4 | ○ | ○ | ○ | ○ | ○ | ○ | ○ |
| Ex. II-5 | ○ | ○ | ○ | ○ | ○ | ⊙ | ⊙ |
| Ex. II-6 | ⊙ | ○ | ○ | ⊙ | ○ | ⊙ | ⊙ |
| Ex. II-7 | ○ | ○ | ○ | ⊙ | ○ | ⊙ | ⊙ |
| Ex. II-8 | ○ | ○ | ○ | ⊙ | ○ | ○ | ⊙ |
| Ex. II-9 | ○ | ○ | ○ | ○ | ○ | Δ | ⊙ |
| Ex. II-10 | ○ | ○ | ○ | ⊙ | ○ | ⊙ | ⊙ |
| Com. Ex. II-1 | Δ | ○ | ○ | x | ○ | x | ○ |
| Com. Ex. II-2 | x | ○ | Δ | ○ | Δ | x | ○ |
| Com. Ex. II-3 | Δ | ○ | ○ | ○ | ○ | x | Δ |
| Com. Ex. II-4 | x | ○ | x | ○ | Δ | ○ | ○ |
| Com. Ex. II-5 | x | ○ | x | ⊙ | x | ⊙ | ○ |
| Com. Ex. II-6 | ○ | Δ | ○ | x | ○ | x | Δ |
| Com. Ex. II-7 | ○ | ○ | ○ | Δ | ○ | x | ○ |
| Com. Ex. II-8 | ○ | ○ | ○ | ○ | ○ | x | Δ |
| Com. Ex. II-9 | ○ | ○ | ○ | ○ | ○ | x | x |
| Com. Ex. II-10 | ○ | ○ | ○ | ⊙ | ○ | x | x |
| Com. Ex. II-11 | ○ | ○ | ○ | x | ○ | x | ○ |
| Com. Ex. II-12 | Δ | ○ | ○ | ○ | Δ | x | ○ |
| Com. Ex. II-13 | ○ | ○ | ○ | ○ | ○ | x | Δ |

What is claimed is:

1. A toner comprising:

toner particles, and strontium titanate fine particles having a number-mean particle size of from 80 to 800 nm, and a quantity of fine particles of 1000 nm or more is not more than 20 number %.

2. A toner as defined in claim 1, wherein the strontium titanate fine particles includes aggregates of primary particles having a mean primary particle size of from 30 to 150 nm.

3. A toner as defined in claim 1, wherein the toner particles have strontium titanate fine particles adhered thereto in a mean number of from 5 to 50 for each toner particle.

4. A toner as defined in claim 1, wherein a quantity of addition of strontium titanate fine particles is from 0.3 to 5.0% by weight relative to the toner particles.

5. A toner comprising:

colored particles;

metallic oxide fine particles treated with a hydrophobicizing agent, and having a number-mean particle size of from 10 to 90 nm; and strontium titanate fine particles having a number-mean particle size of from 80 to 800 nm, and a quantity of particles of 1000 nm or more being not more than 20 number %.

6. A toner as defined in claim 5, wherein the metallic oxide fine particles treated with the hydrophobicizing agent comprise silica particles having a number-mean particle size of from 10 to 30 nm and titania particles having a number-mean particle size of from 10 to 90 nm.

7. A toner as defined in claim 5, wherein the colored particles comprise:

colorants; and polyester resin particles having a number-mean molecular weight of from 3000 to 6000, a ratio of weight-mean molecular weight to number-mean molecular weight of 2:6, a glass transition point of from 50° to 70° C. and a softening point of from 90° to 110° C.

8. A toner as defined in claim 5, wherein a quantity of addition of the strontium titanate fine particles is from 0.3 to 5.0% by weight relative to the toner particles, and a quantity of addition of the metallic oxide fine particles is from 0.3 to 5.0% by weight to the toner particles.

9. A toner as defined in claim 6, wherein the titania particles are anatase-type titania particles.

10. A toner comprising:

colored particles;

toner particles having an angle of repose x (°), a volume-mean particle size D50 (μm), and an apparent specific gravity of looseness AD (g/cc) which respectively satisfy the following relations:

$$AD=(-0.005x+k1)\times(D50/8.5)^{1/2}$$

$$0.57\leqq k1\leqq 0.64$$

$$AD=k2x\ (D50)^{1/2}$$

$0.135 \leqq k2 \leqq 0.158$ $28° \leqq x \leqq 38°$ $3\ \mu m \leqq D50 \leqq 10\ \mu m$.

11. A toner as defined in claim 10, wherein the toner is for use in a full-color developing apparatus.

12. A toner comprising:

colored particles;

first inorganic fine particles having a number-mean particle size of from 10 to 30 nm; and second inorganic fine particles having a number-mean particle size of from 100 to 1000 nm;

the toner having an angle of repose x (°), a volume-mean particle size D50 (μm), and an apparent specific gravity of looseness AD (g/cc) which respectively satisfy the following relations:

$AD=(-0.005x+k1)\times(D50/8.5)^{1/2}$ $0.57 \leqq k1 \leqq 0.64$ $AD=k2x\ (D50)^{1/2}$ $0.135 \leqq k2 \leqq 0.158$ $28° \leqq x \leqq 38°$ $3\ \mu m \leqq D50 \leqq 10\ \mu m$.

13. A toner as defined in claim 12, wherein the first inorganic fine particles have a triboelectric characteristic in relation to the colored particles taken as the reference such that they are of the same polarity as the colored particles and have a larger chargeability than the colored particles, and wherein the second inorganic fine particles have an opposite polarity relative to the colored particles.

14. A toner as defined in claim 12, further comprising third inorganic fine particles having a number-mean particle size of from 30 to 90 nm.

15. A toner as defined in claim 14, wherein the first inorganic fine particles are silica or titania fine particles; the second inorganic fine particles are strontium titanate fine particles; and the third inorganic fine particles are anatase-type titania fine particles.

16. A toner as defined in claim 15, wherein the first inorganic fine particles have a hydrophobicity of 50 or more.

17. A developing agent comprising:

magnetic carrier particles;

toner particles with an externally added additive, the toner particles having an angle of repose x (°), a volume-mean particle size D50 (μm), and an apparent specific gravity of looseness AD (g/cc) which respectively satisfy the following relations:

$AD=(-0.005x+k1)\times(D50/8.5)^{1/2}$ $0.57 \leqq k1 \leqq 0.64$ $AD=k2x\ (D50)^{1/2}$ $0.135 \leqq k2 \leqq 0.158$ $28° \leqq x \leqq 38°$ $3\ \mu m \leqq D50 \leqq 10\ \mu m$.

18. A developing agent as defined in claim 17, wherein the external additive comprises:

first inorganic fine particles having a number-mean particle size of from 10 to 30 nm; and second inorganic fine particles having a number-mean particle size of from 100 to 1000 nm.

19. A developing agent as defined in claim 18, wherein the magnetic carrier particles have a triboelectric characteristic in relation to the toner particles taken as the reference such that they have a polarity opposite to the toner particles, the first inorganic fine particles have a triboelectric characteristic in relation to the toner particles taken as the reference such that they have a chargeability of the same polarity as but larger than the toner particles, and the second inorganic fine particles have a polarity opposite to the toner particles and a larger chargeability than that of the magnetic carrier.

20. A developing agent as defined in claim 18, further comprising third inorganic fine particles having a number-mean particle size of from 30 to 90 nm.

* * * * *